US005466022A

United States Patent [19]

Derman

[11] Patent Number: 5,466,022

[45] Date of Patent: Nov. 14, 1995

[54] SAFETY CABLE LOCK FOR KNOB-OPERATED DOOR

[76] Inventor: Jay S. Derman, P.O. Box 949, Redondo Beach, Calif. 90277

[21] Appl. No.: 155,576

[22] Filed: Nov. 19, 1993

[51] Int. Cl.[6] ..... E05C 19/10

[52] U.S. Cl. ..... 292/246; 292/264; 292/DIG. 30

[58] Field of Search ..... 292/246, 194, 292/264, DIG. 16, DIG. 44, 250, DIG. 30, DIG. 41, DIG. 13

[56] References Cited

U.S. PATENT DOCUMENTS

| | | | |
|---|---|---|---|
| 186,319 | 1/1877 | Dietz | 292/264 |
| 2,726,112 | 12/1955 | Conhagen | 292/264 |
| 3,809,418 | 5/1974 | Canfield | 292/264 |
| 3,853,343 | 12/1974 | Hunter | 292/264 |
| 4,155,577 | 5/1979 | Raymond | 292/264 |

*Primary Examiner*—Rodney M. Lindsey
*Attorney, Agent, or Firm*—Monty Koslover Assoc.

[57] ABSTRACT

A safety cable locking device for a knob-operated door mounted in a door frame including a framing stud. The device comprises an anchor member, a wire plastic covered cable, a lag bolt and a bushing. The anchor member contains the bushing and is fastened to a door frame framing stud by the lag bolt which passes through a hole in the anchor member and bushing into the framing stud. The cable ends pass the side of the anchor member through two holes which are located to cooperate with the bushing, causing the cable ends to be angled apart at 15 to 30 degrees. The cable loop is passed over the inside door knob. If the door is pushed open, tension force is put on the cable causing the edges of the anchor member holes to bite into the angled cable, locking the cable in place and preventing the door from being opened further.

2 Claims, 1 Drawing Sheet

SAFETY CABLE LOCK FOR KNOB-OPERATED DOOR

BACKGROUND AND SUMMARY OF THE INVENTION

1. Field of the Invention

This invention relates to a safety lock for knob-operated doors, and in particular, those devices using a cable or chain positioned over a doorknob to prevent the door from being pushed open.

2. Prior Art Devices

There presently:exists a number of devices and methods for securing knob-operated doors. Among these are: U.S. Pat. No. 4,478,442 by Martin; U.S. Pat. No. 4,135,748 by Correnti et al; U.S. Pat. No. 4,155,577 by Raymond; U.S. Pat. No. 4,135,748 by Roberts; U.S. Pat. No. 3,640,558 by Gewirtz et al; U.S. Pat. No. 3,451,708 by Brooks, and U.S. Pat. No. 878,607 by Cairns. The last cited patent by Cairns, was issued in 1908, indicating that the concept of restraining knob-operated doors by chain or cable is quite old.

With the exception of Martin and Correnti, all of the above cited inventions utilize chains which fasten around the doorknob on the inside of the door and also in some manner are attached to the doorway framework. Thus any knob-operated door may be prevented from being fully opened.

Martin utilizes an anchor block fastened by a lag bolt to a doorway framework, a wire cable which is wrapped around a doorknob and is fastened to the anchor block, and a sleeve which fits over the cable.

Correnti et al utilizes a box to be placed in the wall of a doorway for anchoring a cable; a cable which is wrapped around a doorknob and a special two-section sleeve which fits over the cable between it and the doorknob. Provision is made for storing the cable and sleeve in the wall box when the device is not in use.

A review of the Martin device shows that the cable security depends on beads or slugs which are attached to its ends and prevent the cable from being pulled through holes in the anchor block. Experience with similarly beaded cable ends has shown that such beads or slugs may be stripped off if sufficient tension force is applied, as could happen if someone tried to force a door restrained by a cable over a doorknob. In other cable door lock devices, the cable ends may be butted and clamped. However, this method also is considered to be relatively weak in securing a cable against a strong applied tension force, since the butted cable ends may be pulled apart.

The Correnti et al device, on the other hand, while incorporating strong restraint on its cable ends, requires a skilled installation of its wall box; something the average homeowner might not be able or wish to do.

In view of Martin and Correnti et al and similar devices, there is an apparent need for a cable locking device for knob operated doors which incorporates very strong restraint on its cable ends to resist forcing open, and is simple enough in construction for any average homeowner to install in a doorway.

SUMMARY OF THE INVENTION

In accordance with the present invention, the device comprises an anchor member, a wire plastic covered cable, a lag bolt and a bushing. The anchor member contains the bushing and is fastened to a door frame framing stud by the lag bolt which passes through a hole in the anchor member and bushing into the framing stud. The cable ends pass through two holes in the side of the anchor member and are angled apart by the bushing, causing the cable to be held against the hole edges. The cable loop is passed over the inside door knob. If the door is pushed open, tension force is put on the cable causing the edges of the anchor member holes to bite into the cable, restraining its movement. The bushing edges also bite into the cable, adding further restraint.

Accordingly, a prime object of this invention is to provide a safety cable lock for knob-operated doors which incorporates the utmost restraint on its cable ends, preventing loosening the cable to allow forcible entry.

It is another object of this invention to provide a simple door locking device that can be easily installed by the average homeowner.

Further objects and advantages of the present invention will become apparent from the study of the following portion of the specification, the claims and the attached drawings.

DESCRIPTION OF THE PREFERRED EMBODIMENT

Figure 1:
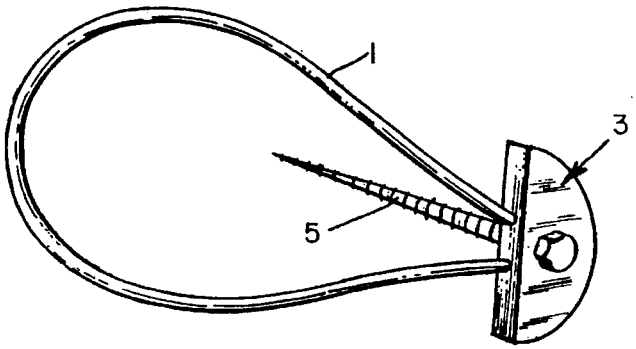
FIG. 1 is a generally perspective view showing an embodiment of the present invention device ready for installation, particularly illustrating the relationship of the wire cable to an anchor member and fastening lag bolt.

Referring particularly to the drawings, there is shown in FIG. 1 a perspective view of a preferred embodiment of the safety cable locking device for knob-operated doors, according to the present invention. The device comprises a plastic covered wire cable 1, a metal anchor member 3 to which the cable 1 ends are fastened, a lag bolt 5 and a bushing 6. The bushing 6 is located inside the anchor member 3 on the axis of the lag bolt 5, with the lag bolt shank passing through it.

Figure 5:
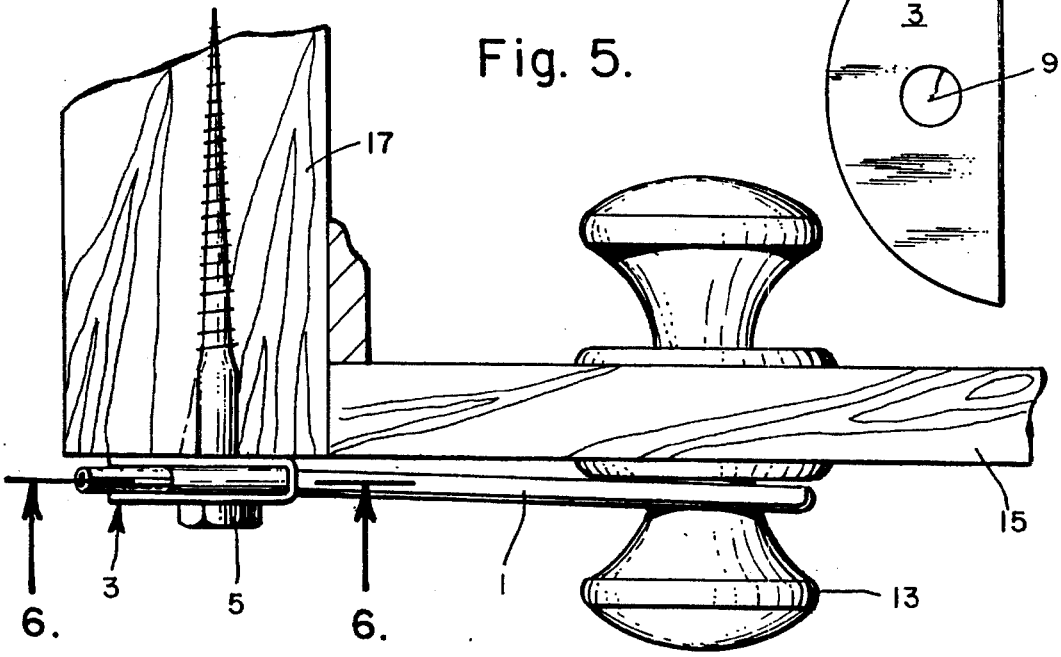
FIG. 5 is a top view of the present invention device installed fastened to a door frame stud and looped over an inside doorknob on a knob-operated door.

As shown in FIG. 5, the device is easily installed by pushing the lag bolt 5 through holes in the side of the anchor member 3, through the bushing 6 and screwing into a door frame stud 17. The cable 1, which is relatively loose, is then slipped over the doorknob 13 on the inside of the door 15. This device can be used also to supplement a standard door lock. The only requirement is that the door be knob-operated.

Refer now to FIGS. 2, 3, 4 and 6 which show detail of the anchor member 3, the bushing 6 and the restraint means applied to the cable 1 ends. The anchor member 3 is a generally circular shaped piece of metal sheet which is folded with two parallel folds spaced apart at its center, so that its cross-section forms a "U" shape. The width of the "U" is made wide enough to accommodate a cable plus a clearance allowance.

Figure 2:
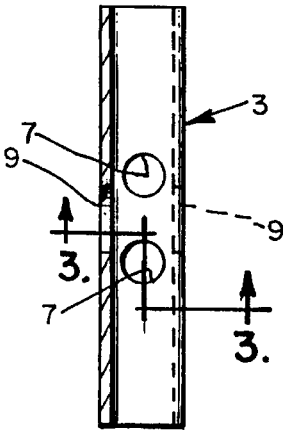
FIG. 2 is an end elevation view of the anchor member narrow side with a partial cross-section view of its folded sides, particularly showing the relative positions of the cable and bolt holes.
Figure 3:
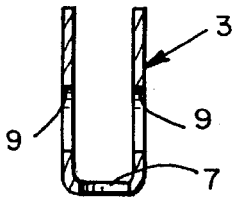
FIG. 3 is a cross-section view of the anchor member taken along line 3—3 of FIG. 2.
Figure 4:
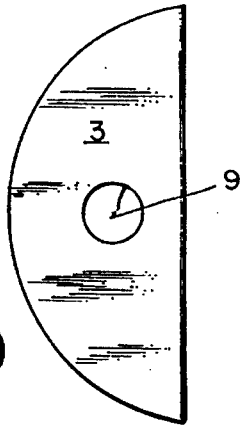
FIG. 4 is a side elevation view of the anchor member.

A first and second hole 7 for the cable are cut in the end side between the folds in the anchor member 3, with the holes 7 located a distance apart, centered on the side length. As shown in FIGS. 2, 3 and 4, third and fourth holes 9 are cut in the center of anchor member 3 sides, located such that the center axis of the holes 9 passes between the first and second holes 7 at 90 degrees. The third and fourth holes 9 are sized to accommodate the shank of the lag bolt 5 with clearance.

Figure 6:
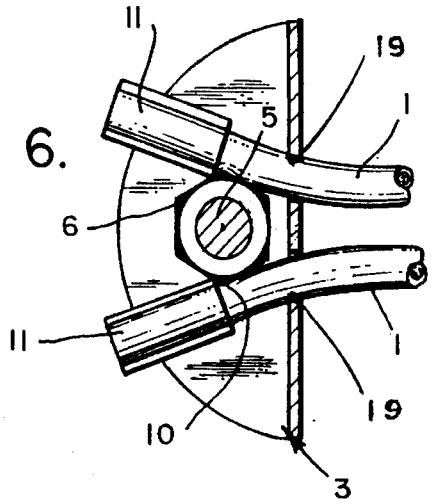
FIG. 6 is a partial cross-section of the present invention device taken along line 6—6 of FIG. 5, and particularly illustrating how the cable ends are made to angle apart by a bushing, forcing the cable to pass through the anchor member holes at an angle and causing the hole edges to bite into the cable.

Refer now to FIG. 6 which is a partial cross-section view of the device taken along line 6—6 of FIG. 5. The bushing 6 is placed inside the anchor member 3 and between the third and fourth holes 9, so that the bushing axis is in line with the center of the holes 9, allowing the shank of the lag bolt 5 to pass through the bushing 6. The purpose of the bushing 6 is to act as a separator, forcing the ends of the cable 1 apart at an angle of 15 to 30 degrees. The bushing thus forces the sides of the angled cable 1 against the edges of the cable holes 7, resulting in deformation dimples 19 formed in the cable surface by the cable hole edges biting into the cable. In practice, the greater the tension pull on the cable 1, the more the edges of the holes 7 will bite into the cable 1, very strongly restraining the cable. This aspect is the heart of the invention.

The bushing 6 itself is illustrated as having a hex nut shaped outer rim. It may instead have a rounded rim having serrated edges. Either bushing configuration will impinge on the cable 1 surfaces, protruding a dimple 10 into the cable and acting as a further restraint on its movement.

The ends of the cable 1 are clamped with metal collars 11. The collars are intended to finish the cable ends and also to serve as a further restraint on cable movement.

From the foregoing description it is apparent that the invention device is simple in construction, having only four separate parts. Its installation poses no problem to an ordinary homeowner. The cable restraint does not depend on beads or slugs fastened to the cable ends as in other inventions. Rather, the cable is very strongly restrained by edges of the anchor member holes cutting into it deeply, with the strength of the latch or bite increasing as the cable is pulled toward the doorknob as would be the case if someone tried to force the door open.

The device is then seen to be an extremely effective safety door opening restraint for knob-operated doors.

The foregoing description and drawings have described a preferred embodiment of the present invention. Alternative embodiments and various modifications may be apparent to those skilled in the art. These alternatives and modifications are considered to be within the spirit and scope of the present invention.

Having described the invention, what is claimed is:

1. A safety cable locking device for a knob-operated door which is mounted in a wooden door frame including a framing stud, said safety cable locking device comprising:

(a) a plastic covered wire cable, said cable being formed in a loop and having its two cable ends made to be nearly parallel to each other;

(b) an anchor member, said anchor member being a piece of metal sheet folded into three portions and having a "U" shape cross-section end view, the first and third portions thereof being parallel to each other and separated by a space allowing for the thickness of said cable, the second portion thereof being at 90 degrees to said first and third portions; said second portion having a first and second hole cut to receive said cable ends; said first and third portions having a third and fourth hole cut to receive a lag bolt, said third and fourth holes located such that their hole center axis passes between said first and second holes at an angle of approximately 90 degrees relative to the axis of said first and second holes;

(c) a bushing, said bushing being placed inside said anchor member between said third and fourth holes, such that the axis of said bushing is in line with the center of said third and fourth holes; said bushing having an outer rim with serrated or pointed edges for the purpose of impinging on the surface of said cable; said bushing diameter selected such that when said bushing is in place and said cable ends are inserted inside said anchor member first and second holes, said bushing diameter will force said cable ends apart at an included angle of 15 to 30 degrees; and (d) a lag bolt extending through said third and fourth holes in said anchor member, through said bushing and into said door frame framing stud in a position allowing the loop of said cable to fit over a knob on said knob-operated door;

whereby said cable ends are positioned inside said anchor member at an angle with the horizontal, such that when said door is pushed open and tension pull is thereby applied to said cable, the edges of said first and second holes in said anchor member will bite deeply into the surface of said cable, strongly restraining any outward movement of said cable and preventing said door from being opened further.

2. The device as recited in claim 1, wherein said plastic covered wire cable includes two metal collars, one of said metal collars being clamped to each end of said cable, acting to finish each end and serving as a secondary restraint on any movement of said cable out of said anchor member.

* * * * *